US005150642A

United States Patent [19]

Moody et al.

[11] Patent Number: 5,150,642

[45] Date of Patent: Sep. 29, 1992

[54] DEVICE FOR APPLYING TORQUE TO A TUBULAR MEMBER

[75] Inventors: Victor Moody, Lowestoft; Andrew Jenner, St. Olaves, both of Great Britain

[73] Assignee: Frank's International Ltd., Norfolk, England

[21] Appl. No.: 755,158

[22] Filed: Sep. 5, 1991

[30] Foreign Application Priority Data

Sep. 6, 1990 [GB] United Kingdom ..... 9019416

[51] Int. Cl.[5] ..... B25B 17/00

[52] U.S. Cl. ..... 81/57.2; 81/57.18

[58] Field of Search ..... 81/57.18, 57.2, 57.21

[56] References Cited

U.S. PATENT DOCUMENTS 4,372,026 2/1983 Mosing ..... 81/57.18 X
4,404,876 9/1983 Eckel ..... 81/57.18
4,437,363 3/1984 Haynes ..... 81/57.18
4,445,403 5/1984 Janzen et al. ..... 81/57.18
4,709,599 12/1987 Buck ..... 81/57.18

*Primary Examiner*—James G. Smith
*Attorney, Agent, or Firm*—Volpe and Koenig

[57] ABSTRACT

A device for applying torque to e.g. a screw-threaded pipe includes a pair of gripping jaws pivotally mounted on a cage and carrying respective followers engaging cam surfaces on the radially inner surface of a rotary drive member. The jaws have friction linings. The case is connected to a clamp on the pipe so as to prevent rotation of the cage relative to the pipe. When a rotary drive is transmitted to the drive member, its cam surfaces operate the gripping jaws to clamp them about the pipe and increases the clamping pressure until the pipe begins to rotate with the drive member. The rotary drive member is mounted on a primary support which is held against rotation about the pipe and provides the required reaction force for the rotation.

4 Claims, 2 Drawing Sheets

DEVICE FOR APPLYING TORQUE TO A TUBULAR MEMBER

This invention relates to devices for applying torque to tubular members, such as pipes and collars, and has a particularly useful but by no means exclusive application in connecting together pipes used in oil and gas exploration and production.

The majority of pipes currently used in oil and gas exploration and production are provided with male and female screw-threaded ends for their assembly. The rotary motion and torque required to achieve the assembly of the pipes is usually applied by means of powered tongs located on one side of the screw-threaded joint co-operating with a stationary reactionary gripping system on the other side of the screw-threaded joint. The powered tongs include gripping jaws housed in a rotary assembly and forced radially inward into engagement with the pipe member whilst simultaneously rotating with the rotary assembly. The inward movement of the gripping jaws relative to the rotary assembly is usually achieved by means of a cam and follower mechanism. The gripping jaws have toothed dies which are designed to penetrate the surface of the pipe to provide the required grip. The movement of the gripping jaws relative to the rotary assembly about the axis of the pipe necessary to actuate the relative movement of the cam and follower mechanism is typically obtained by means of a brake located on the power tongs but in some cases is obtained by using the frictional drag between the jaw assembly and the rotary drive assembly.

With the advent of pipes of high chromium content, the surface damage caused by the gripper dies has become undesirable because it can lead to unacceptable stress concentrations and stress corrosion in sour well conditions. There is therefore a need for a gripping system which will grip the pipe without significantly damaging the surface of the pipe. This can be done by using gripper dies having a modified tooth form but the radial inward loading of the dies into engagement with the surface of the pipe under the actuation of the cam and follower mechanism is often insufficient to prevent the jaws from slipping on the surface of the pipe during the application of torque thereto by the rotary drive assembly. Thus the tendency to slip governs the maximum torque which can be applied to the pipe by the rotary drive assembly.

According to the present invention there is provided a device for applying torque to a tubular member, comprising a primary support for disposition about the tubular member, a drive member mounted on the support for rotation relative thereto about the axis of the tubular member, a secondary support disposed coaxially with the drive member, the drive member being capable of rotation relative to the secondary support, gripping elements pivotally mounted on the secondary support for movement into and out of gripping engagement with the tubular member, cam means and follower means one of which means is carried by the drive member and the other of which means is carried by the gripper elements, whereby the drive member operates the gripping elements through the cam and follower means so that rotation of the drive member relative to the secondary support in one direction actuates pivotal movement of the gripping elements into said gripping engagement with the tubular member and in the opposite direction causes the gripping elements to release their grip on the tubular member, and releasable means whereby the secondary support can be rotationally fixed relative to the tubular member.

According to a preferred feature of the invention, said releasable means comprises clamping means arranged to be releasably clamped about the tubular member and a connection between the clamping means and the secondary support whereby relative rotational movement of the secondary support and tubular member is prevented.

One embodiment of the invention will now be described by way of example with reference to the accompanying drawings in which.

Figure 1:
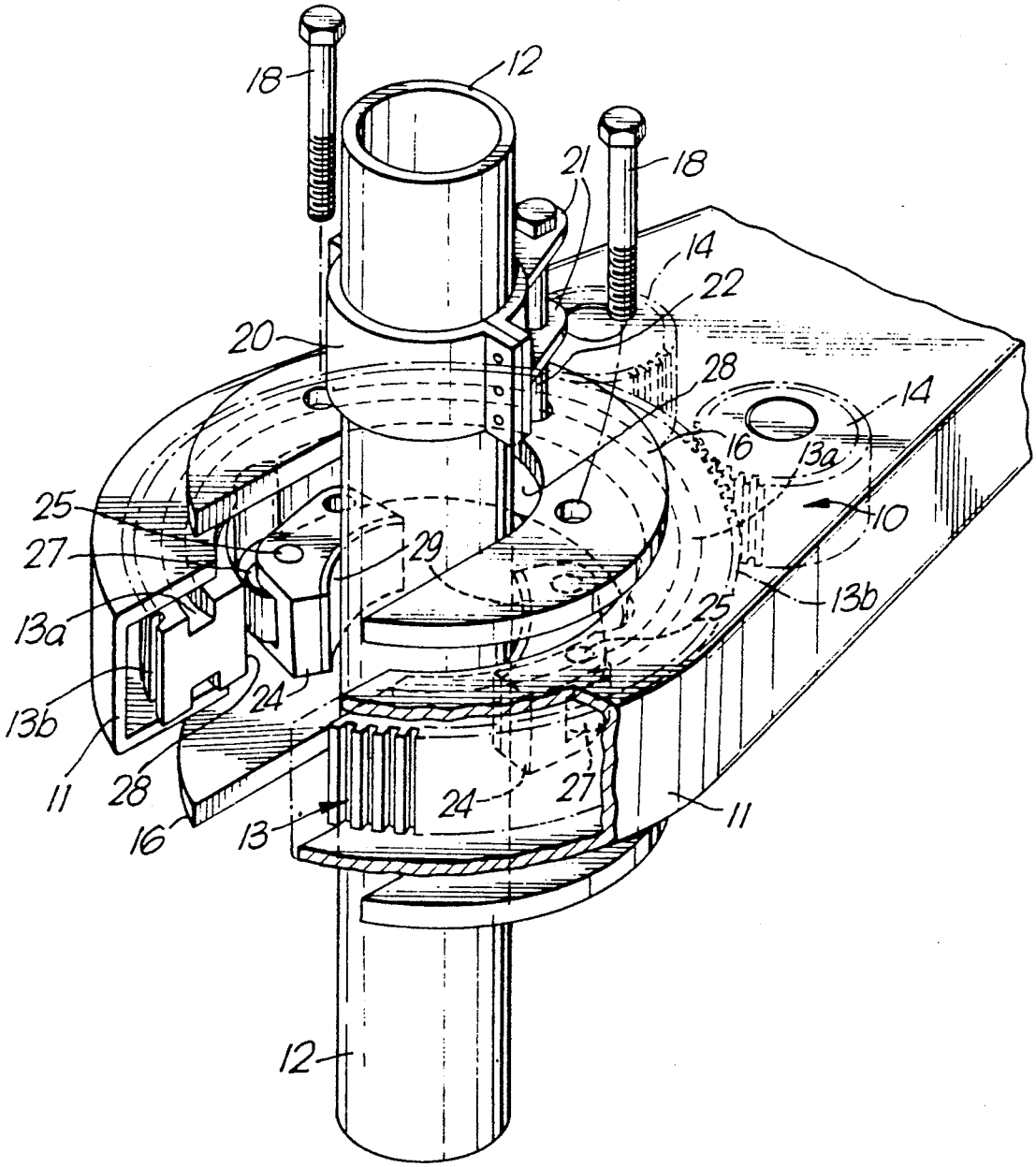
FIG. 1 is a partially exploded view of a device according to the invention.

Referring to the drawings there is shown a power tongs device for applying a torque to a pipe 12 to engage a screw-threaded end of the pipe with the complementary threaded end of another pipe (not shown). The moving parts of the device are mounted on a primary support 10 in the form of a body part with two arms 11 of channel section which extend about opposite sides of the pipe. A gap is left between the ends of the arms 11 to permit the arms to be positioned about the pipe. The channel section arms 11 jointly support a part-annular rotary drive member 13 which extends about the pipe and which has a gap in its periphery to enable the member to be placed about the pipe. The upper and lower faces of the drive member have circumferentially extending slots 13*a* in which spaced rollers (not shown) are mounted on the upper and lower internal faces of the support 10 to provide a bearing for the rotation of the drive member. The rotary drive member has external gear teeth 13*b* which are engaged by two drive gears 14 rotatably mounted in the primary support and so spaced about the axis of the rotary drive member that the latter is permanently in driven engagement with one or other or both of the drive gears despite the gap in its periphery.

Figure 2:
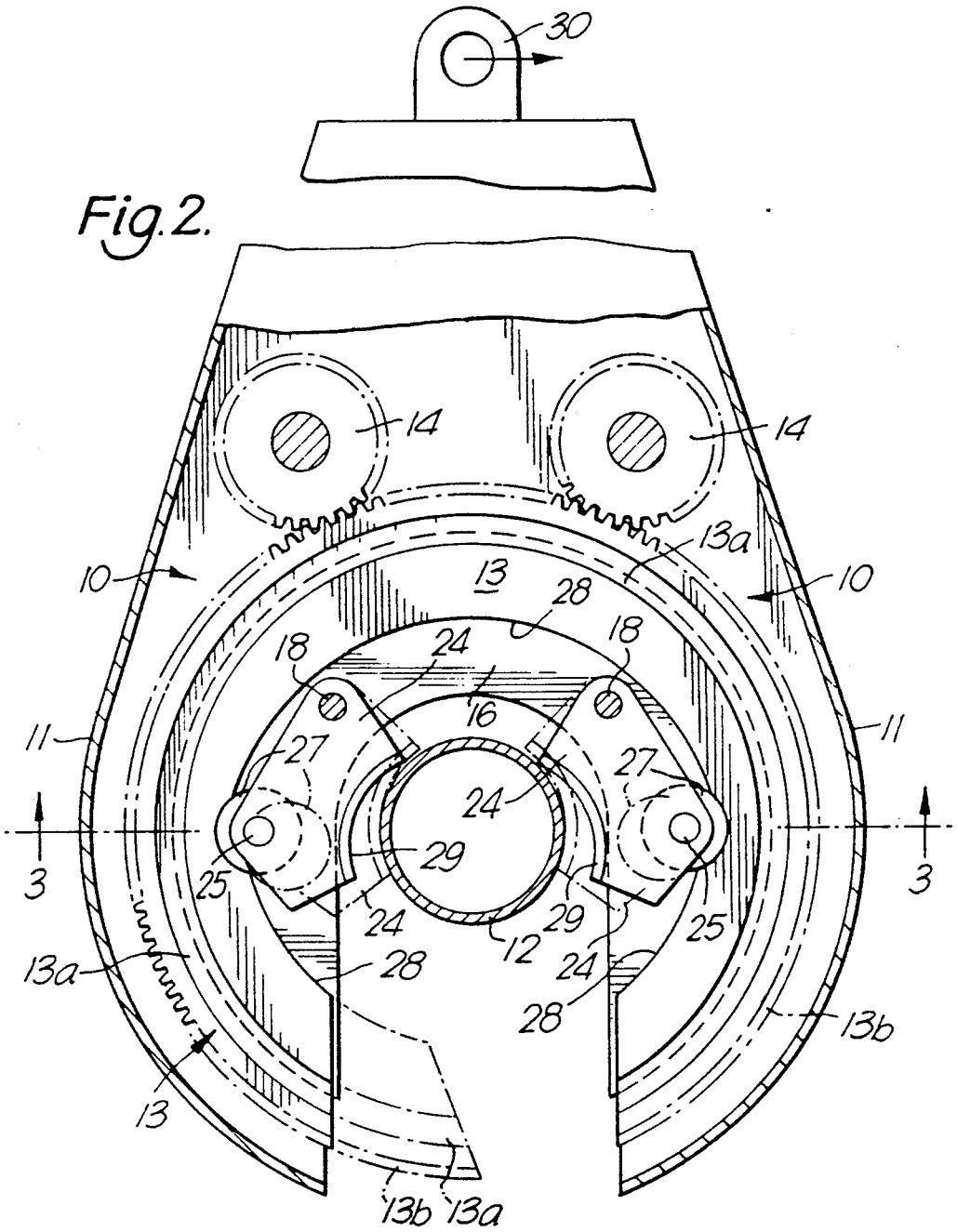
FIG. 2 is a plan view of the device of FIG. 1.
Figure 3:
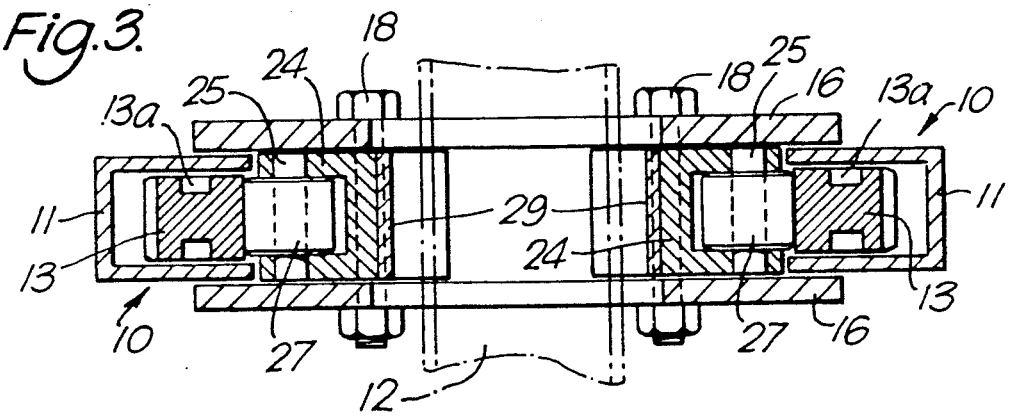
FIG. 3 is a sectional view on the line 3—3 of FIG. 2.

A cage constituting a secondary support comprises upper and lower cage plates 16 which are disposed respectively above and below the primary support 10 and which are connected together in spaced location by bolts 18. The cage plates, which are omitted from FIG. 2 to enable the arrangement to be seen more clearly, have radial slots enabling them to be placed about the pipe. The cage is centred coaxially with the ring of gear teeth 13*a* and, in operation, on the lengthwise axis of the pipe and is rotatable relative to the primary support 10. A clamp 20 is releasably secured about the pipe 12 and has upper and lower lugs 21 in which axially aligned holes are drilled. A bolt 22 extends through these holes and into an aligned hole in the upper cage plate 16 of the cage so that the cage is anchored to the clamp 20 and to the pipe 12.

Two gripper jaws 24 are disposed between the cage plates and in the central opening of the rotary drive member 13. The bolts 18 extend through holes in the jaws and form pivots about which the jaws can swivel relative to the cage plates 16. Spaced away from their pivot supports, the gripper jaws 24 carry pivot pins 25 providing axles for respective rollers 27 which engage respective cam surfaces 28 formed on the radially inner surface of the rotary drive member. Each of the two cam surfaces 28 is in two parts which are mirror images of each other, merging adjacent the section line 3—3, where their radius relative to the central axis of the rotary member is a maximum, this radius decreasing with distance from the section line 3—3. The rollers are thus shown in their neutral or inoperative position in FIG. 2 at which position the rollers lodge in shallow recesses for location purposes. The gripper jaws are provided with suitably profiled arcuate surfaces 29 carrying friction linings for engagement with opposite sides of the pipe.

In operation of the device, rotation of the drive gears 14 in either direction by a suitable motor (not shown) causes the rotary drive member 13 to rotate about the axis of the pipe. The cage is initially prevented by reason of its connection to the clamp 20 on the pipe from rotating with the rotary drive member, and the resulting movement of the cam surfaces 28 relative to the follower rollers 27 causes the gripper jaws to move progressively inward into clamping engagement with the external surface of the pipe. The gripping force on the pipe thus increases until it reaches a value at which the frictional force imposed on the pipe is sufficient to cause the pipe to rotate with the rotary drive member. A reaction force is applied to a connection point 30 on the primary support to prevent rotation of the support about the pipe. When the threaded connection is adequately tightened, or as the case may be released, the motor drive to the drive gears 14 is stopped and a make-up break-out pin (not shown) of known construction is actuated to release the cam loading on the rollers 27 of the jaws, releasing the grip of the jaws on the pipe. These pins prevent reverse movement of the jaws past them. The clamp bolt 22 is then disengaged and the clamp is removed from the pipe. The make-up break-out pins are then disengaged to enable the rotation of the cage to be reversed to bring the rollers 27 back to their neutral position.

The illustrated arrangement is highly advantageous over known arrangements in which frictional drag between the rotary drive member and the cage is employed to cause the relative rotation of these two elements necessary to cause the cam and roller engagement to operate gripping movement of the jaws. In these known arrangements, when the radial force between the cams and rollers reaches a value at which the cage begins to rotate with and at the same speed as the rotary drive member, the frictional force between the jaws and the pipe has reached its maximum value, and this value may be inadequate to cause the pipe to rotate if friction alone between the pipe and jaws is relied upon to produce rotation of the pipe. Furthermore a proportion of the applied torque is dissipated in applying the gripping force to the pipe. In the present arrangement, relative rotation of the rotary drive member and the cage, and consequently the inward tightening movement of the jaws on the pipe caused by the cams and followers, continues until rotation of the pipe commences. No part of the applied torque is lost in the application of the gripping force to the pipe and even potential energy in the pipe by reason of the applied torque may be recovered.

We claim:

1. A device for applying torque to a tubular member, comprising a primary support for disposition about the tubular member, a drive member mounted on the support for rotation relative thereto about the axis of the tubular member, a secondary support disposed coaxially with the drive member, the drive member being capable of rotation relative to the secondary support, gripping elements pivotally mounted on the secondary support for movement into and out of gripping engagement with the tubular member, cam means and follower means one of which means is carried by the drive member and the other of which means is carried by the gripper elements, whereby the drive member operates the gripping elements through the cam and follower means so that rotation of the drive member relative to the secondary support in one direction actuates pivotal movement of the gripping elements into said gripping engagement with the tubular member and in the opposite direction causes the gripping elements to release their grip on the tubular member, and releasable means whereby the secondary support can be rotationally fixed relative to the tubular member.

2. A device as claimed in claim 1, wherein according to a preferred feature of the invention, said releasable means comprises clamping means arranged to be releasably clamped about the tubular member and a connection between the clamping means and the secondary support whereby relative rotational movement of the secondary support and tubular member is prevented.

3. A device as claimed in claim 1, wherein the cam and follower means comprises followers mounted on the gripping elements and cam surfaces on the drive member, and wherein the cam surface associated with each follower extends circumferentially of the drive member and is symmetrical about a mid-point in its length, whereby movement of the follower in either direction from said mid-point rotates the gripping element carrying the follower in a radially inward direction.

4. A device as claimed in claim 3, wherein a shallow locating recess for the follower is formed at said mid-point of each cam surface.

* * * * *